US012385190B2

(12) United States Patent
Woergoetter et al.

(10) Patent No.: US 12,385,190 B2
(45) Date of Patent: Aug. 12, 2025

(54) TAMPING UNIT FOR TAMPING SLEEPERS OF A TRACK

(71) Applicant: PLASSER & THEURER EXPORT VON BAHNBAUMASCHINEN GESELLSCHAFT M.B.H., Vienna (AT)

(72) Inventors: Herbert Woergoetter, Engerwitzdorf (AT); Andreas Poeschl, St. Georgen an der Gusen (AT); Nikolaus Matzinger, Oberneukirchen (AT)

(73) Assignee: Plasser & Theurer Export von Bahnbaumaschinen Gesellschaft, Vienna (AT)

( * ) Notice: Subject to any disclaimer, the term of this patent is extended or adjusted under 35 U.S.C. 154(b) by 332 days.

(21) Appl. No.: 17/767,563

(22) PCT Filed: Sep. 10, 2020

(86) PCT No.: PCT/EP2020/075290
§ 371 (c)(1),
(2) Date: Apr. 8, 2022

(87) PCT Pub. No.: WO2021/069172
PCT Pub. Date: Apr. 15, 2021

(65) Prior Publication Data

US 2024/0102251 A1 Mar. 28, 2024

(30) Foreign Application Priority Data

Oct. 8, 2019 (AT) ..... A 324/2019

(51) Int. Cl.
*E01B 27/16* (2006.01)

(52) U.S. Cl.
CPC ..... *E01B 27/16* (2013.01); *E01B 2203/12* (2013.01)

(58) Field of Classification Search
CPC ..... E01B 27/16; E01B 2200/12
See application file for complete search history.

(56) References Cited

U.S. PATENT DOCUMENTS 4,537,135 A * 8/1985 Theurer ..... E01B 27/16 104/12
5,048,425 A * 9/1991 Theurer ..... E01B 27/16 104/12

(Continued)

FOREIGN PATENT DOCUMENTS

AT 379178 B 11/1985
AT 3916 U2 10/2000

(Continued)

*Primary Examiner* — Jason C Smith
(74) *Attorney, Agent, or Firm* — Laurence A. Greenberg; Werner H. Stemer; Ralph E. Locher

(57) ABSTRACT

A tamping assembly for tamping sleepers of a track has a tamping unit with tamping tools. The tamping tools are located opposite one another, are mounted on a height-adjustable tool support, and, by way of drives, can be caused to vibrate and can be fed relative to each other. Each tamping tool includes a pivot lever, which can be rotated about a feed axis, and an inner and an outer tamping pick retainer. Each tamping pick retainer can be laterally pivoted relative to the pivot lever. The outer tamping pick retainer can be pivoted about a first pivot axis and the inner tamping pick retainer can be pivoted about a second pivot axis. The second pivot axis is arranged at an offset to the first pivot axis. Thus, it is no longer necessary to adjacently arrange elements for pivoting the tamping pick retainers.

14 Claims, 4 Drawing Sheets

(56) References Cited

U.S. PATENT DOCUMENTS

| | | | | | |
|---|---|---|---|---|---|
| 5,269,226 | A * | 12/1993 | Theurer | ..... | E01B 27/16 104/12 |
| 9,803,323 | B2 * | 10/2017 | Hofstaetter | ..... | E01B 27/16 |
| 10,633,801 | B2 * | 4/2020 | Steiner | ..... | E01B 27/16 |
| 10,808,362 | B2 * | 10/2020 | Seyrlehner | ..... | B06B 1/162 |
| 2020/0157745 | A1 * | 5/2020 | Seyrlehner | ..... | E01B 27/16 |
| 2024/0102251 | A1 * | 3/2024 | Woergoetter | ..... | E01B 27/16 |

FOREIGN PATENT DOCUMENTS

| | | | | | |
|---|---|---|---|---|---|
| AT | 520267 | A1 | | 2/2019 | |
| AT | 522456 | B1 | | 11/2020 | |
| CN | 1046578 | A | | 10/1990 | |
| CN | 1048074 | A | | 12/1990 | |
| CN | 1071723 | A | | 5/1993 | |
| CN | 1077509 | A | * | 10/1993 | ..... E01B 27/17 |
| CN | 101481896 | A | * | 7/2009 | |
| CN | 105074089 | A | | 11/2015 | |
| CN | 108291368 | A | | 7/2018 | |
| CN | 108291369 | A | | 7/2018 | |
| EP | 0208826 | A1 | | 1/1987 | |
| EP | 0564433 | A1 | | 10/1993 | |

* cited by examiner

TAMPING UNIT FOR TAMPING SLEEPERS OF A TRACK

FIELD AND BACKGROUND OF THE INVENTION

The invention relates to a tamping unit for tamping sleepers of a track, comprising a tamping assembly with opposing tamping tools which are mounted on a height-adjustable tool carrier, and which can be set in vibration via drives and can be squeezed towards each other, wherein each tamping tool comprises a swivelling lever which can be rotated about a squeezing axis and an inner and an outer tamping tine support, and wherein each tamping tine support is laterally swivelable relative to the swivelling lever.

In order to restore or maintain a given track geometry, tracks with ballast beds are regularly maintained by means of a tamping machine. In the process, the tamping machine travels along the track and lifts the track panel formed from sleepers and rails to a target level by means of a lifting/lining unit. The new track position is fixed by tamping the sleepers by means of a tamping unit. The tamping unit comprises tamping tools with tamping tines which penetrate the ballast bed with a vibration being applied to them and are squeezed towards each other during a tamping process. In the process, the ballast is compacted below the respective sleeper.

Two tamping assemblies are assigned to each rail of the track, each tamping one sleeper on both sides of the rail. Each tamping assembly comprises two opposing tamping tools. Usually, two tamping tines are arranged next to each other on each tamping tool. Specifically, an inner tamping tine penetrating next to the rail and an outer tamping tine penetrating at a greater distance from the rail are provided in each case. With both tamping tines having penetrated the ballast side by side, a wide range of action is available. However, when there are obstacles in the track and especially in the area of a turnout, there is often too little space for the two tamping tines arranged next to each other to penetrate at the same time. This is why, for example, a tamping unit with so-called tilting tines is known from AT 379 178 B. Laterally swivelable tamping tine supports are arranged on the respective tamping tool. In this way, first the outer tamping tine can be swivelled up separately if there is space between the rails, sleepers, and track fixtures for only one tamping tine to penetrate. If there is no possibility to penetrate at all on one side of the sleeper, then the inner tamping tine is also swivelled up. The tamping assembly can then be lowered only with the tamping tines of the opposite tamping tool. The disadvantage of the known arrangement of tilting tines is the space required for the respective swivel mechanism including swivel drives.

SUMMARY OF THE INVENTION

The object of the invention is to provide a tamping unit of the kind mentioned above with a compact design.

According to the invention, this object is achieved by the features of as claimed. Dependent claims indicate advantageous embodiments of the invention.

It is provided that the outer tamping tine support is swivelable about a first swivelling axis and that the inner tamping tine support is swivelable about a second swivelling axis arranged offset relative to the first swivelling axis. This eliminates the need to arrange elements for swivelling the tamping tine supports next to each other. The offset arrangement enables optimised use of the available installation space. The result is a compact tamping assembly that has small external dimensions, especially in a longitudinal direction of the track.

Advantageously, a first contact element is arranged on an outer side of the inner tamping tine support, wherein a second contact element is arranged on an inner side of the outer tamping tine support and wherein the two contact elements engage with each other when the tamping tine supports are swivelled down.

When working with both tamping tines, there is thus a positive connection between the two tamping tine supports. This prevents excessive stress on a swivel bearing when a higher counterforce of the ballast acts on the assigned tamping tine. In addition, the increase in torsional stiffness achieved has a positive effect on tamping quality.

In a preferred further embodiment of the invention, the outer tamping tine support is directly connected to a first swivel drive and the inner tamping tine support is connected to a second swivel drive via a coupler arrangement mounted on the assigned swivelling lever. The arrangement of the coupler arrangement allows a further reduction of the space required. This makes the design of the tamping assembly even more compact.

In this context, it is advantageous if the coupler arrangement comprises a swivelling element rotatably mounted on the swivelling lever and a connecting element connecting the swivelling element to the inner tamping tine support. This arrangement is both robust and space-saving. Only revolute joints are used that are easy to manufacture and have a long service life with little maintenance. In another embodiment of the coupler arrangement, it may also be useful to use translationally mounted coupler elements.

A further simplification provides that the swivelling element is arranged to swivel about the first swivelling axis. Thus, on the respective swivelling lever, the outer tamping tine support and the swivelling element can be rotated about the same swivelling axis. This enables a compact design of the corresponding bearings with a continuous bearing shaft.

The function of the tamping unit is advantageously extended if a catch is arranged on the connecting element and if the catch is in contact with a link element of the outer tamping tine support when swivelling up the inner tamping tine support. In this way, when the inner tamping tine support swivels up, the outer tamping tine support swivels up with it. For swivelling up both tamping tine supports, activation of the second swivel drive is sufficient, while the first swivel drive remains enabled.

The narrow and robust design of the swivel arrangements is further improved by the outer tamping tine support having a recess through which the coupler arrangement is passed. For example, the outer tamping tine support has a fork with a deepened recess in the direction of the swivel bearing so that the recess is suitable for the coupler arrangement to pass through. Advantageously, the inner tamping tine support is also forked in the area of the assigned swivel bearing, the coupler arrangement being linked centrally.

In a simple embodiment of the tamping unit according to the invention, a hydraulic cylinder is assigned to each tamping tool as a drive for squeezing and for applying vibration. A hydraulic control is set up in such a way that a vibration movement is superimposed on a squeezing movement during a squeeze process. A pulsating pressure is applied to one chamber of the hydraulic cylinder. During a penetration process of the tamping tines in a ballast bed, only one vibration is applied.

In this embodiment, it is advantageous if the hydraulic cylinders of the two opposing tamping tools are arranged one below the other. This achieves a compact design of the unit, with small external dimensions in the longitudinal direction of the track.

In another embodiment of the invention, a squeeze cylinder is assigned to each tamping tool, wherein each squeeze cylinder is coupled to an eccentric drive for applying vibration. A narrow design is also achieved here with squeeze cylinders arranged next to one another or one below the other. A corresponding solution is disclosed in the publication AT 520 267 A1, the contents of which are incorporated into the present application.

An advantageous further development provides that several tamping assemblies are arranged one behind the other in a longitudinal direction of the track for the simultaneous tamping of several sleepers. The narrow design of the respective tamping assembly enables this arrangement with unrestricted function of the tilting tines.

It is advantageous if the tamping assemblies are identical in construction. This simplifies manufacturing and reduces maintenance because fewer different spare parts are needed. In addition, a higher-level control of the jointly arranged tamping assemblies is facilitated. The same kinematic properties of the individual tamping assemblies make it easy to implement synchronous motion sequences.

Advantageously, the tool carriers of the tamping assemblies arranged one behind the other are mounted height-adjustably in a shared tamping unit frame. This enables them to be laterally displaced or rotated about a vertical axis together by adjusting the tamping unit frame. In this way, the tamping assemblies arranged one behind the other can be easily positioned above a diverging rail of a turnout.

The application possibilities of a tamping unit for the simultaneous tamping of several sleepers are improved by the fact that each tool carrier of the tamping assemblies arranged one behind the other can be adjusted separately in height by means of its own actuator. For example, the tamping assemblies arranged one behind the other can be lowered to different depths. This allows successive tamping of a sleeper in different depth zones. In addition, lowering individual tamping assemblies can be interrupted if there is not enough space for the tamping tines to penetrate.

BRIEF DESCRIPTION OF THE FIGURES

In the following, the invention is explained by way of example with reference to the accompanying figures. The following figures show in schematic illustrations.

DETAILED DESCRIPTION OF THE INVENTION

Figure 1:
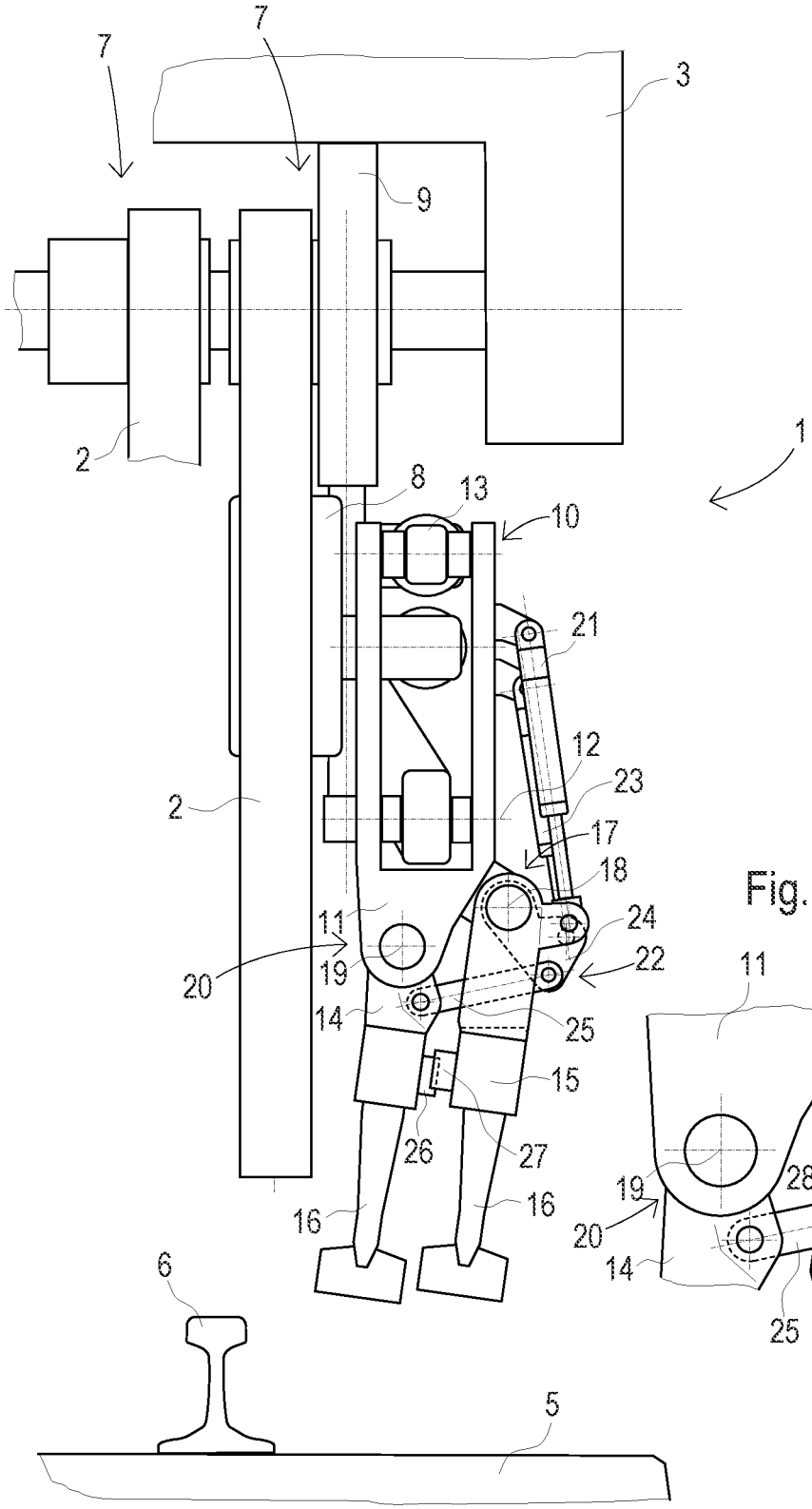
FIG. 1 Tamping unit with a tamping assembly in a front view

The tamping unit 1 shown in FIG. 1 comprises a tamping unit frame 2, which is laterally displaceably mounted on a machine frame 3 of a track maintenance machine not described in more detail. In operation, the track maintenance machine travels along a track with sleepers 5 supported on a ballast bed 4 and rails 6 fastened to it. The sleepers 5 are tamped by means of the tamping unit 1.

Figure 8:
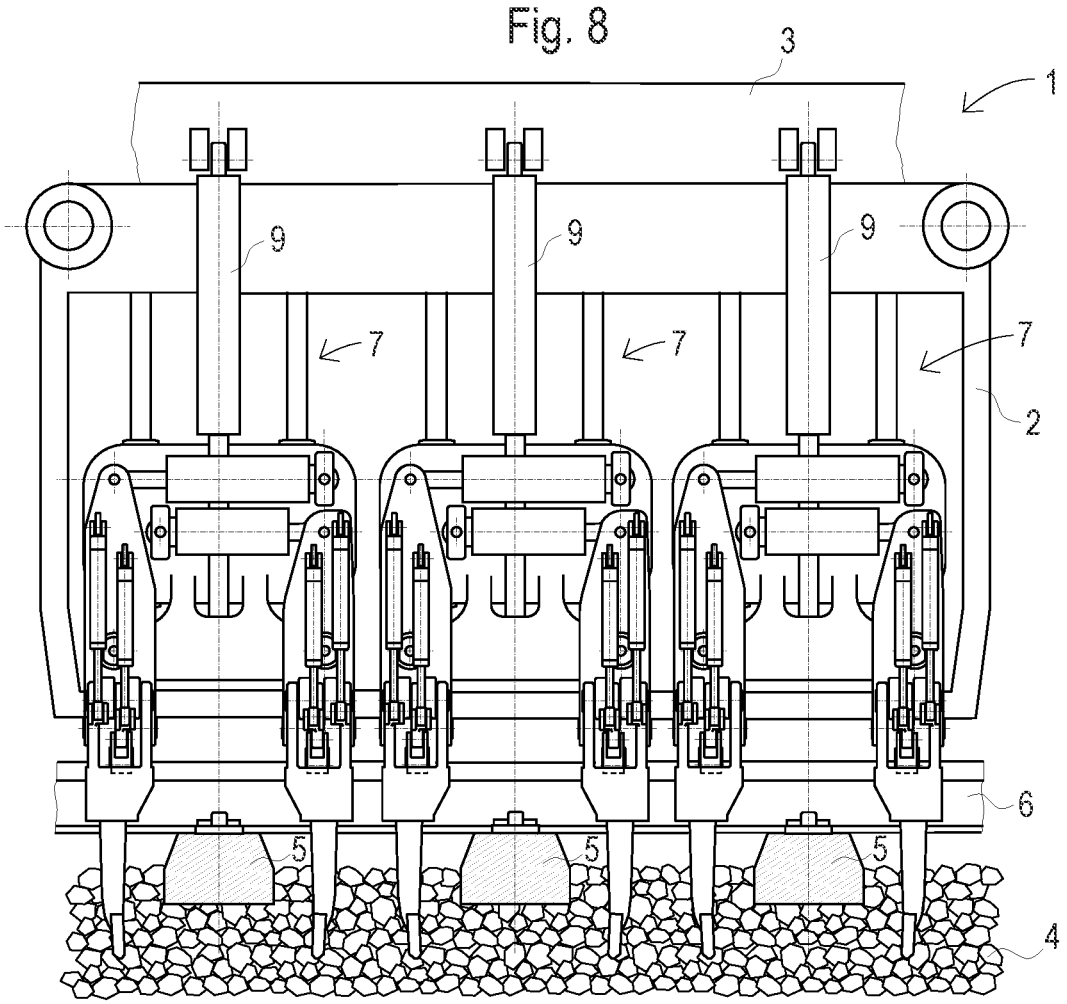

At least one tamping assembly 7 is arranged in the tamping unit frame 2. In a tamping unit 1 for the simultaneous tamping of several sleepers 5, several tamping assemblies 7 are arranged one behind the other (FIG. 8). The respective tamping assembly 7 comprises a tool carrier 8, which is height-adjustably guided in vertical guides of the tamping unit frame 2. A lowering or lifting movement takes place by means of an assigned height adjustment drive 9. For the tamping of a sleeper 5, the tamping unit 1 comprises several tamping unit frames 2 arranged next to each other in the transverse direction of the track with tamping assemblies 7 mounted therein. Advantageously, they are rotatable about a vertical axis and separately laterally displaceable to enable positioning over a diverging rail of a turnout.

On the tool carrier 8 of the respective tamping assembly 7, two tamping tools 10 are mounted opposite each other in relation to a sleeper 5 to be tamped.

Specifically, the respective tamping tool 10 comprises a swivelling lever 11 which is mounted on the tool carrier 8 so as to be rotatable about a squeezing axis 12. The squeezing axis 12 is usually aligned in the transverse direction of the track.

An upper arm of the swivelling lever 11 is coupled to a drive 13 in order to cause a squeezing movement with a superimposed vibration movement during a tamping process. An inner tamping tine support 14 and an outer tamping tine support 15 for fixing tamping tines 16 are arranged on a lower arm of the swivelling lever 11. The designations as inner tamping tine support 14 and outer tamping tine support 15 refer to the position of two tamping assemblies 7 which can be lowered on both sides of a rail 6. The inner holders 14 of the two tamping assemblies 7 are directly opposite each other with respect to the rail 6. The tamping tines 16 fixed in the outer tamping tine supports 15 penetrate the ballast bed 4 at a greater distance from the rail 6.

If there is no space between the sleepers 5 and rails 6 for a tamping tine 16 to penetrate, it can be swivelled up before lowering the tamping assembly 7. This occurs especially when tamping turnouts or crossings, where diverging or crossing rails as well as control mechanisms are obstacles.

To swivel up the outer tamping tine support 15, it is connected to the swivelling lever 11 by means of a first revolute joint 17 so as to be rotatable about a first swivelling axis 18. According to the invention, a second swivelling axis 19 is arranged offset to this. If necessary, the inner tamping tine support 14 is swivelled up around this second swivelling axis 19. For example, a connection of the inner tamping tine support 14 to the swivelling lever 11 is designed as a second revolute joint 20, which is offset downwards and inwards relative to the first revolute joint 17. Both swivelling axes 18,19 are parallel to each other and aligned normal to the squeezing axis 12.

Advantageously, the outer tamping tine support 15 is directly connected to a first swivel drive 21. For example, this is linked to the outer tamping tine support 15 on one side and to the swivelling lever 11 on the other side. The inner tamping tine support 14 is connected to a second swivel drive 23 via a coupler arrangement 22. This is in turn linked to the swivelling lever 11. The swivel drives 21, 23 are preferably designed as hydraulic cylinders.

In the example shown, the coupler arrangement 22 comprises a swivelling element 24 rotatably mounted on the swivelling lever 11 and a connecting element 25 connecting the swivelling element 24 to the inner tamping tine support 14. The swivelling element 24 is advantageously rotatable about the first swivelling axis 18. The first revolute joint 17 thus also comprises the linkage of the swivelling element 24 to the swivelling lever 11.

In order to avoid uneven loads on the revolute joints 17, 20 during a squeeze process, the tamping tine supports 14, 15 are positively connected via additional contact elements 26, 27 when swivelled down. As shown in FIG. 1, a first contact element 26 is arranged on an outer side of the inner tamping tine support 14. A second contact element 27 is arranged on the inner side of the outer tamping tine support 15 facing it. The two contact elements 26, 27 are designed so that they can engage with each other. For example, the first contact element 26 comprises a wedge that fits into a wedge-shaped recess in the second contact element 27.

Figure 2:
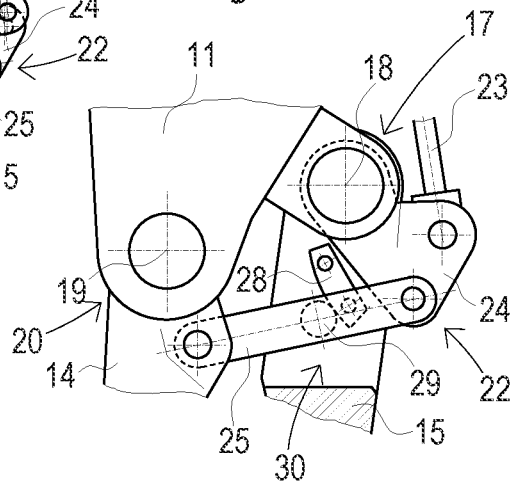
FIG. 2 Swivel bearing of the tamping assembly according to FIG. 1 in detail FIG. 3 Tamping assembly in a side view FIG. 4 Tamping tool with swivel mechanism for inner tamping tine support FIG. 5 Tamping tool with swivel mechanism for outer tamping tine support FIG. 6 Swivelling movement of the inner tamping tine support FIG. 7 Swivelling movement of the outer tamping tine support FIG. 8 Tamping unit for simultaneous tamping of several sleepers

By means of the swivel drives 21, 23 first the outer tamping tine support 15 together with the tamping tine 16 can be swivelled up and then the inner tamping tine support 14 together with the tamping tine 16. With a further development shown in FIG. 2, both tamping tine supports 14,15 can be swivelled up simultaneously by means of the second swivel drive 23. The first swivel drive 21 is depressurized.

For synchronous swivelling up, a link element 28 is attached to the outer tamping tine support 15 at a point adjacent to the connecting element 25. A catch 29 is attached to the connecting element 25 as a counter element. This catch 29 is in contact with the link element 28. During a swivelling-up process, the catch 29 slides along the link element 28 and thus causes the outer tamping tine support 15 to swivel along with it. The shape and position of the link element 28 and the catch 29 determine the swivel movement of the outer tamping tine support 15.

Figure 3:
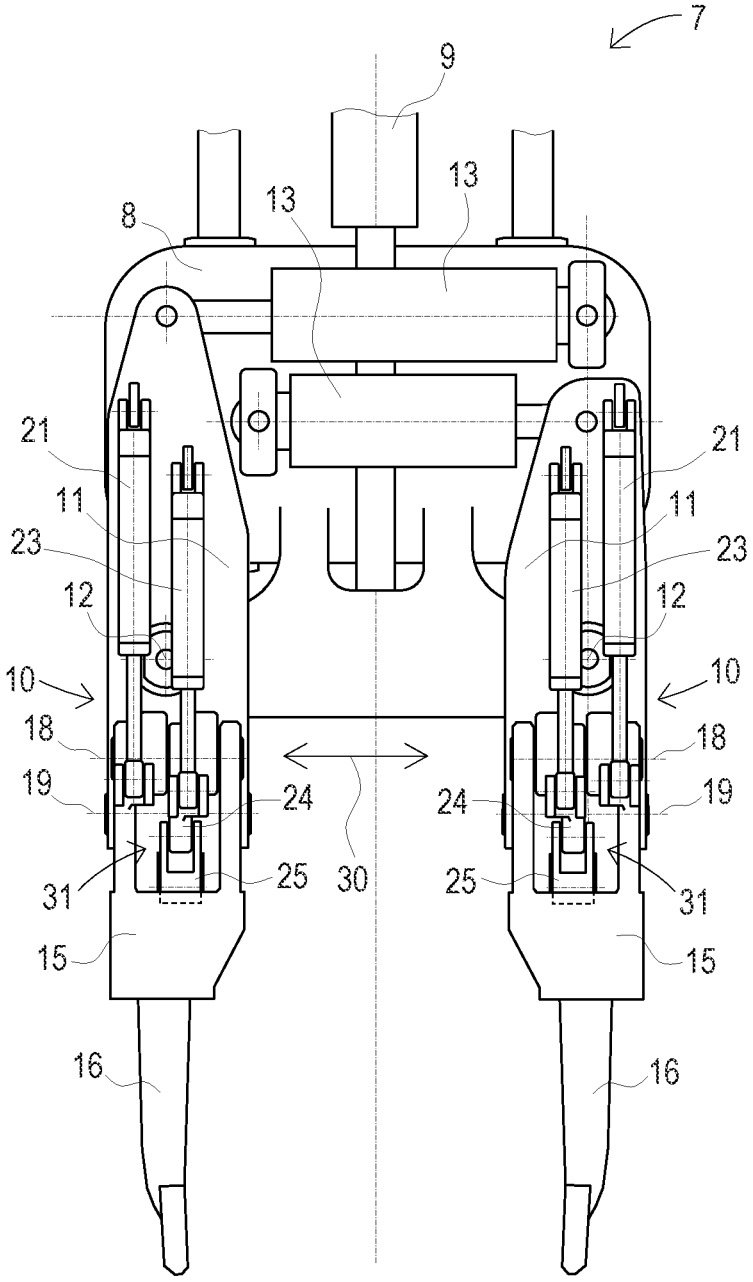

In FIG. 3 it can be seen that the outer tamping tine support 15 has a fork towards the top. In this way, the outer tamping tine support 15 is connected to the swivelling lever 11 at two bearing points spaced apart in the direction of the swivelling axis 30. Between them there is a recess 31 through which the coupler arrangement 22 is passed. The inner tamping tine support 14 also has two bearing points spaced apart in the direction of the swivelling axis 30. In between, the connecting element 25 engages the inner tamping tine support 14. Despite the narrow design, this ensures a robust bearing of the tamping tine supports 14, 15.

In this example, the swivelling levers 11 are connected to hydraulic cylinders as drives 13. In this case, the respective hydraulic cylinder is designed to generate a squeezing movement with a superimposed vibration movement. A narrow design in the direction of the swivelling axis 30 is achieved by the hydraulic cylinders being arranged one below the other. The strokes and pressures of the hydraulic cylinders are coordinated with the respective lever ratio of the swivelling levers 11, so that the same squeeze forces and vibration amplitudes occur at the ends of the tamping tines 16. In this case, it can be useful to arrange the squeezing axes 12 offset in the vertical direction.

In an arrangement not shown, the drives 13 are designed as a squeeze cylinder and an eccentric drive. The respective swivelling lever 11 is coupled to the eccentric drive via an assigned squeeze cylinder. Specifically, each squeeze cylinder is connected to an eccentric shaft in order to generate the vibration movement when the eccentric shaft rotates. In addition, the tamping tines 16 are squeezed towards each other when the squeeze cylinders are activated. For a narrow design, it is advantageous if the squeeze cylinders are arranged next to each other. The eccentric drive is arranged above or below this. Brackets aligned upwards or downwards are mounted on the eccentric shaft, to which the squeeze cylinders are connected.

Figure 4:
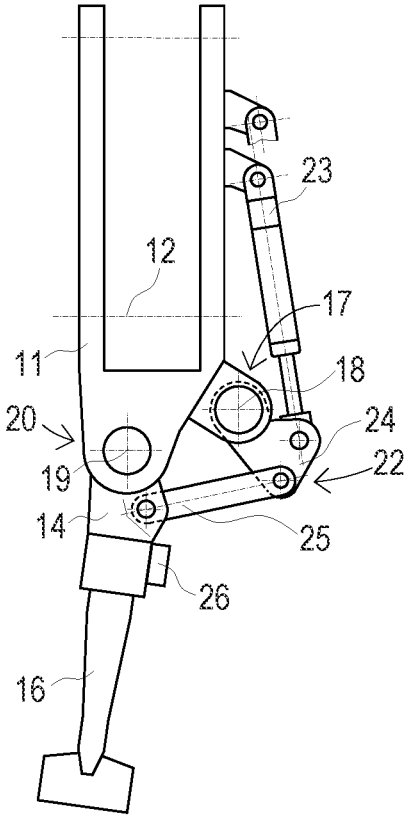
Figure 6:
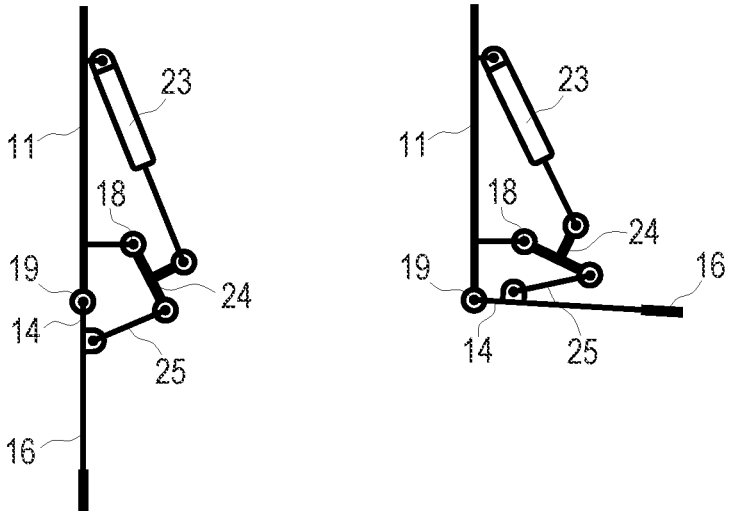

A swivelling-up process of the inner tamping tine 16 is explained with reference to FIGS. 4 and 6. The assigned second swivel drive 23 is designed as a hydraulic cylinder. One end of the cylinder is rotatably linked to the upper arm of the swivelling lever 11. The piston rod is hinged to the swivelling element 24. The swivelling element 24, which is rotatable about the first swivelling axis 18, and the inner tamping tine support 14, which is rotatable about the second swivelling axis 19, form a double rocker together with the connecting element 25 as a coupler. An actuation of the double rocker by activating the second swivel drive 23 is shown in FIG. 6. The starting position according to FIG. 4 is illustrated on the left. The illustration on the right shows the arrangement with the inner tamping tine support 14 swivelled up together with the tamping tine 16.

Figure 5:
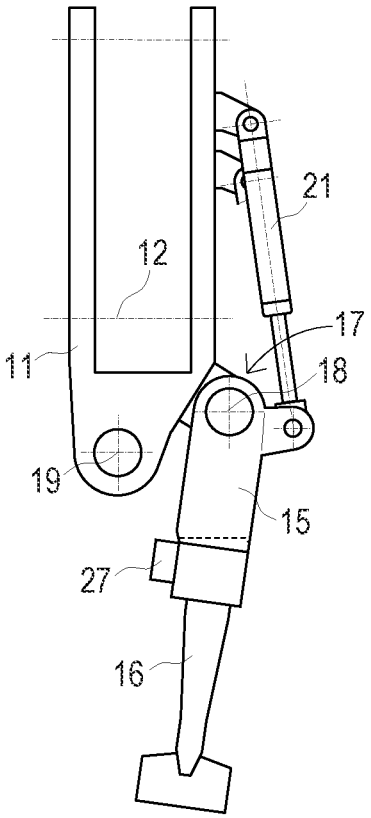
Figure 7:
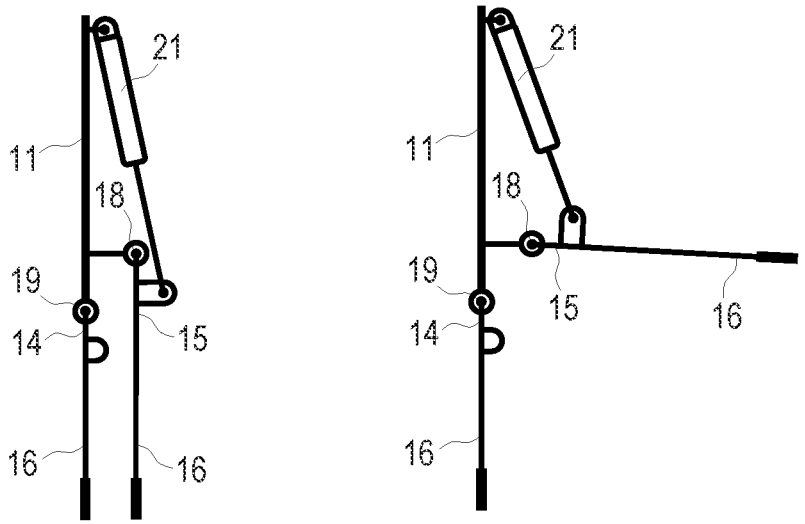

The swivel arrangement of the outer tamping tine support 15 is shown in FIGS. 5 and 7. In this case, the assigned first swivel drive 21 is linked to the swivelling lever 11 on one side and directly to the outer tamping tine support 15 on the other side. The eccentric linkage causes the tamping tine support 15 to swivel when the first swivel drive 21 is actuated. Both tamping tine supports 14, 15 can also be swivelled up simultaneously by means of the link element 28 and the catch 29. The first swivel drive 21, which is designed as a hydraulic cylinder, is depressurized.

The different swivel arrangements allow a particularly narrow design in the direction of the swivelling axis 30. This makes it possible to arrange several tamping assemblies 7 one behind the other in a shared tamping unit frame 2. FIG. 8 shows a corresponding arrangement for the simultaneous tamping of three sleepers 5. Each tamping assembly 7 is favourably assigned its own height adjustment drive 9 in order to be able to lower individual tamping assemblies 7 separately in the event of obstacles in the track. In addition to being separately lowerable, there is the advantage of an identical construction of all tamping assemblies 7. This facilitates the manufacturing and maintenance of the tamping unit 1.

In addition, successive tamping of a sleeper 5 in different depth zones is possible. For example, the frontmost tamping assembly 7 is lowered deeper than the middle tamping assembly 7. The rearmost tamping assembly 7 is lowered less deeply than the middle tamping assembly 7. In this way, with the tamping unit 1 advancing sleeper by sleeper, each sleeper is tamped three times with decreasing penetration depth. Especially with a large layer thickness of the ballast bed 4, such multiple tamping leads to improved ballast compaction.

The invention claimed is:

1. A tamping unit for tamping sleepers of a track, the tamping unit comprising:

a tamping assembly with opposing tamping tools mounted on a height-adjustable tool carrier;

drives configured to set said tamping tools into vibration and to squeeze said tamping tools towards one another;

each of said tamping tool including a swivelling lever mounted for rotation about a squeezing axis and inner and outer tamping tine supports;

said outer tamping tine support being connected to said swivelling lever at a first revolute joint such that said outer tamping tine support is laterally swivelable relative to said swivelling lever about a first swivelling axis; and said inner tamping tine support being connected to said swivelling lever at a second revolute joint such that said inner tamping tine support is laterally swivelable relative to said swivelling lever about a second swivelling axis arranged offset relative to said first swivelling axis.

2. The tamping unit according to claim 1, wherein a first contact element is arranged on an outer side of said inner tamping tine support, a second contact element is arranged on an inner side of said outer tamping tine support, and said first and second contact elements engage in one another when said tamping tine supports are swivelled down.

3. The tamping unit according to claim 1, wherein said outer tamping tine support is directly connected to a first swivel drive and said inner tamping tine support is connected to a second swivel drive via a coupler arrangement mounted on the respectively assigned swivelling lever.

4. The tamping unit according to claim 3, wherein said coupler arrangement comprises a swivelling element rotatably mounted on said swivelling lever and a connecting member connecting said swivelling element to said inner tamping tine support.

5. The tamping unit according to claim 4, wherein said swivelling element is arranged to swivel about said first swivelling axis.

6. The tamping unit according to claim 4, which comprises a catch arranged on said connecting element, wherein said catch is in contact with a link element of said outer tamping tine support when said inner tamping tine support is swivelled up.

7. The tamping unit according to claim 3, wherein said outer tamping tine support is formed with a recess through which said coupler arrangement is passed.

8. The tamping unit according to claim 1, wherein said drives comprise a respective hydraulic cylinder assigned to each tamping tool for squeezing and for applying vibration.

9. The tamping unit according to claim 8, wherein said hydraulic cylinders of said two opposing tamping tools are arranged one below another.

10. The tamping unit according to claim 1, wherein each said tamping tool has an assigned squeeze cylinder and each squeeze cylinder is coupled to an eccentric drive for applying vibration.

11. The tamping unit according to claim 1, wherein said tamping assembly is one of a plurality of several tamping assemblies arranged one behind another in a longitudinal direction of the track for simultaneously tamping multiple sleepers.

12. The tamping unit according to claim 11, wherein said plurality of tamping assemblies are identical in construction.

13. The tamping unit according to claim 11, which comprises a shared tamping unit frame, and wherein said tool carriers of said tamping assemblies that are arranged one behind the other are mounted height-adjustably in said shared tamping unit frame.

14. The tamping unit according to claim 11, wherein each tool carrier of said tamping assemblies that are arranged one behind the other are separately adjustable in height by way of a separate actuator.

* * * * *